US009481970B2

(12) United States Patent
Scott

(10) Patent No.: US 9,481,970 B2
(45) Date of Patent: Nov. 1, 2016

(54) GABION

(71) Applicant: HESCO BASTION LIMITED, Leeds, Yorkshire (GB)

(72) Inventor: Kenny Scott, Fife (GB)

(73) Assignee: HESCO BASTION LIMITED, Leeds, Yorkshire (GB)

( * ) Notice: Subject to any disclaimer, the term of this patent is extended or adjusted under 35 U.S.C. 154(b) by 0 days.

(21) Appl. No.: 14/413,051

(22) PCT Filed: Jun. 6, 2013

(86) PCT No.: PCT/GB2013/051490

§ 371 (c)(1),
(2) Date: Jan. 6, 2015

(87) PCT Pub. No.: WO2014/006361

PCT Pub. Date: Jan. 9, 2014

(65) Prior Publication Data

US 2015/0204039 A1 Jul. 23, 2015

(30) Foreign Application Priority Data

Jul. 6, 2012 (GB) ..... 1212089.5

(51) Int. Cl.
*E02D 29/02* (2006.01)
*E02B 3/10* (2006.01)
*E02B 3/04* (2006.01)

(52) U.S. Cl.
CPC ..... *E02B 3/108* (2013.01); *E02B 3/04* (2013.01); *E02D 29/0208* (2013.01)

(58) Field of Classification Search
CPC ... E02D 29/0208; E02D 31/004; E01F 8/025
See application file for complete search history.

(56) References Cited

U.S. PATENT DOCUMENTS 855,584 A * 6/1907 Meale ..... E02B 3/14 405/16
3,840,947 A * 10/1974 Burbidge ..... E02D 29/0208 220/494

(Continued)

FOREIGN PATENT DOCUMENTS

EP 0 466 726 B1 1/1992
EP 1 951 963 B1 8/2008

(Continued)

OTHER PUBLICATIONS

International Search Report of International Application No. PCT/GB2013/051490 mailed on Dec. 18, 2013.

*Primary Examiner* — Tara M. Pinnock
(74) *Attorney, Agent, or Firm* — Ping Wang; Andrews Kurth Kenyon LLP

(57) ABSTRACT

The present invention relates to a gabion comprising opposed first and second side walls connected together at spaced intervals along the length of the gabion by a plurality of partition walls, the first and second side walls comprising open framework panels, and wherein the first side wall is lined with a first lining material comprising a layer of a sheet material, the sheet material having a relatively low water permeability compared with an unlined open framework panel, and further wherein the second side wall is lined with a second lining material having a higher water permeability than the first lining material. The present invention also relates to a multi-compartmental gabion having similar features. The present invention also relates to a water containment system comprising a gabion or multi-compartmental gabion according to the invention. The present invention also relates to a method of deploying a water containment system.

31 Claims, 5 Drawing Sheets

(56) References Cited

U.S. PATENT DOCUMENTS 4,483,640 A * 11/1984 Berger ..... E02D 29/0208 210/170.03
5,156,496 A * 10/1992 Vidal ..... E02D 29/0241 405/262
5,320,455 A * 6/1994 Mattox ..... E02B 3/066 405/262
5,641,244 A * 6/1997 Bestmann ..... E02B 3/125 405/15
5,647,695 A * 7/1997 Hilfiker ..... E01F 8/025 405/258.1
5,658,096 A * 8/1997 Von Kanel ..... E02D 29/0241 405/16
6,368,017 B2 * 4/2002 Black ..... E03F 1/002 210/170.03
6,648,549 B1 * 11/2003 Urriola ..... E03F 1/005 210/170.03
7,033,118 B2 * 4/2006 Hilfiker ..... E02D 29/0241 405/262
7,147,405 B2 * 12/2006 Ferraiolo ..... E02D 29/0241 405/262
8,689,501 B2 * 4/2014 Chamoux ..... E02D 29/0208 52/173.1
2008/0247830 A1 * 10/2008 Heselden ..... E02D 29/0208 405/273
2008/0264546 A1 * 10/2008 Olsta ..... E02D 29/0208 156/91
2010/0024343 A1 * 2/2010 Eggermont ..... E02D 29/0208 52/648.1
2010/0111611 A1 * 5/2010 Olsta ..... E02D 31/004 405/128.1

FOREIGN PATENT DOCUMENTS

GB WO 2008087073 A1 * 7/2008 ..... E02D 29/0208
JP 2003232023 A * 8/2003
WO 2005/080691 9/2005

* cited by examiner

GABION

This invention concerns gabions; in particular gabions which may be erected and filled with a suitable fill material to provide a defence against military or other forms of assault, or against environmental dangers such as flood waters. In particular, the invention concerns such gabions which may be multi-compartmental in nature, allowing their rapid erection, and which are sufficiently robust to withstand deployment even under harsh climatic conditions for a significant period of time. Further particularly, the invention relates to a water containment system formed using gabions and, in particular, to improvements in and relating to rapidly deployable flood-defence systems.

There are many types of water containment systems which are suitable for preventing bodies of water from flooding adjacent areas of land. In some instances, the water containment systems may be located along a coastline to present a barrier between a sea or ocean and land along the coastline. In other instances, the water containment systems may be located inland alongside a lake or river to prevent water in the lake or river reaching adjacent areas of land. Examples of permanent water containment systems are levees, flood-walls and sea-walls.

Certain areas of land, whilst prone to flooding from an adjacent body of water, may not have a permanent water containment system in place. This may be because the risk of flooding is so infrequent that it would not be economically viable to construct a permanent water containment system on those areas of land. Conversely, it may be the case that there are frequent risks of flooding in those areas of land, but there are insufficient governmental funds to construct a permanent water containment system. Therefore, in such areas of land, it may be necessary, during times of flood-risk, to construct temporary flood defences. As will be appreciated, rapid deployment of a flood-defence system may be of importance during onset of flood-waters.

Gabions are generally structures of the type which comprise side wall panels, end panels and partition panels which connect the wall panels, and all the panels are usually rectangular and may be pivotally attached or connected together so that the structure can be moved between an expanded (or deployed) condition for use and a collapsed (or folded) condition for storage and transport. In the deployed condition, the structure is elongated and the panels define a row of cavities, cells, or compartments extending in the length direction of the structure, each cavity being defined by side panels and partition panels, apart from the end cavities which are defined by side panels, partition panels and end panels. The cavities can be filled with ballast or building materials so that the structure turns into a robust wall which can be used for defences for flooding, for military equipment and personnel, and for shoring of hillsides and river banks and the like, or simply as a property or other boundary. They can be used side-by-side, end-to-end, and/or in superimposed relationship, depending upon the use to which they are to be put.

In the folded, unfilled, condition, the structure is basically flat and the partition and end panels lie in parallel planes, whilst the side panels of each side are folded one relative to another in zig-zag or concertina fashion, so that the plan footprint of the collapsed structure is rectangular.

It is to be mentioned that when reference is made to "rectangular" herein, square, which is one form of rectangle, is specifically to be included.

The present invention contemplates the applications of gabions in the realm of water containment systems and, in particular, flood-defence systems.

An example of a gabion structure of the type set forth above is illustrated in European Patent EP-B-1951963, and an accompanying description is also included in that Patent.

Rapid deployment of a flood-defence system may be desirable during onset of flood-waters and gabions lend themselves to such situations where rapid deployment is desirable. The pivotally attached, connected multi-compartmental gabions described in EP-B-1951963 can be easily and quickly erected, and can be filled with readily available and inexpensive ballast or fill material.

A further example of a structure of the type set forth is illustrated in European Patent No. 0 466 726 B1 in FIGS. 1 and 2 thereof, and an accompanying description is also included in that Patent.

The pivotally attached, connected multi-compartmental gabions described in EP-B-0466726 have similar advantages to those disclosed in EP-B-1951963. Again, then can be filled with readily available and inexpensive ballast or fill material, especially in those embodiments, as described in EP-B-0466726, where the panels are of mesh and have a lining material of a geo-textile to prevent particles of the fill material from falling through the holes of the mesh. Typically, the lining material may comprise a geo-textile made from non-woven polypropylene.

This invention seeks to achieve an improvement in the area of water containment systems, particularly in systems formed from gabions having a combination of mesh and lining material construction, and to provide water containment systems without the disadvantages of the present systems.

According to an aspect of the present invention there is provided a gabion comprising opposed first and second side walls connected together at spaced intervals, the first and second side walls comprising open framework panels, and wherein the first side wall is lined with a first lining material having a relatively low water permeability compared with an unlined open framework panel, and further wherein the second side wall is lined with a second lining material having a higher water permeability than the first lining material.

Where a gabion of this type is filled with ballast or fill material to form a flood-defence system, the side of the gabion having the low-permeability lining material may be located to face toward a body of water from which floods may be expected. Should flood-waters advance sufficiently to wash against the gabion, then the low-permeability first lining material may inhibit the passage of water into the fill material through the open framework, or mesh, of the gabion. This may serve to inhibit saturation of the fill material, which may be undesirable as this may weaken the structure of the flood-defence system. Further, it may reduce the likelihood of fill material being washed away by the action of flood-waters washing against the side of the gabion.

It may be the case that high winds or high tides, or a combination of both, may cause flood-waters to over-top the water-facing side of the gabion (e.g. during a storm-surge). This may negate the effect of the lining material and the fill material may become saturated in any event. Additionally, adverse weather conditions which are likely to accompany flood-conditions may mean that water from rainfall also soaks into the fill material and may be a factor in causing the fill material to become saturated. As noted above, this may undesirable in certain instances.

If the fill material becomes saturated, then a concern is that this may result in overloading of the gabion walls and/or connections between adjacent walls and, potentially, may lead to failure of at least a section of the gabion structure. However, because the second wall (located to face the land-side, or dry-side, of the flood-defence system in this arrangement) is lined with the second lining material having a higher water permeability than the first lining material, any water which might soak into the fill material may be able to drain away through the open framework, or mesh, of the second side wall after passing through the second lining material.

By lining the second side wall also, this can inhibit the washing away of fill material through the open framework of the second side wall. However, because the permeability of the lining of the second side wall is higher than that of the lining of the first side wall, some water which may have been absorbed in the fill material may be allowed to pass through the lining of the second side wall, and therefore drain from the gabion to reduce the potential for the fill material to become saturated.

It may be desirable that the fill-material retains some water content in some instances. Indeed, it may be unavoidable in the proposed arrangement in extreme weather and/or flood conditions. A non-zero level of water content in the material filling compartments of the gabion may be useful because the water can fill interstitial spaces between elements of the fill material and/or pores of elements of the fill material. This can effectively increase the mass of the material contained within the compartments, and thus may increase the weight and/or stability of the overall structure. If the structure has increased weight and/or stability, this may improve the ability of the structure to resist movement caused by wave impacts and/or by the weight of water bearing against it.

Optionally, the first lining material may be impermeable.

Optionally, the first lining material may extend over a connection between the first side wall and at least one partition wall extending therefrom and may extend at least partly across a surface of at least one partition wall extending from the first side wall. Further optionally, the second lining material may extend over a connection between the second side wall and at least one partition wall extending therefrom, and may extend at least partly across a surface of at least one partition wall extending from the second side wall. Yet further optionally, a portion of a surface of at least one partition wall may be unlined.

In an optional arrangement where part of a partition wall between two adjacent compartments, or cells, of a multi-compartmental gabion is unlined, this may serve to allow fill material in the adjacent compartments to pass through the open framework of the unlined portion of the partition wall. This may be useful in allowing the fill material in one compartment to bind, or interlock, with the fill material in an adjacent compartment. Such binding or interlocking may serve to improve the strength of the structure and may potentially reduce shearing between adjacent compartments. Shearing between adjacent compartments may arise due to water washing against the water-facing side of the gabion (e.g. during wave impacts).

The first and/or second lining material may comprise a sheet material which, optionally, may comprise a multi-layer material.

Optionally, the first lining material may comprise Dura-Dry®. Further optionally, the second lining material may comprise Geo-Tex® 643, manufactured by Propex™, and/or Geo-Tex® 645, by Propex™.

The first side wall and/or second side wall and/or partition walls of the gabion may be formed from rigid mesh panels. Optionally, the partition walls and first and second sidewalls may be connected to one another by pivotal connections. Optionally, at least one of the pivotal connections is a releasable connection which when released allows a side wall element, where present, to open with respect to a compartment.

The releasable connection may comprise a hinge member associated with an edge of each adjacent wall to be connected.

The pivotal interconnection between connected walls and/or wall elements may be achieved by providing interconnected walls and/or wall elements with a row of apertures along an interconnection edge thereof and by providing a coil member helically threaded through a plurality of apertures along the interconnection edge.

The or each hinge member may be a helical spring.

The or each releasable connection can comprise a releasable locking member releasably securing the hinge members of each pivotal connection to one another. The pivotal connections ideally allow the gabion to fold concertina-wise for storage or transport, for example by causing adjacent walls of the gabion to fold about a plurality of pivot axes. Specifically, the pivot axes may be spaced apart to enable adjacent walls to lie face-to-face when the gabion is in a folded configuration.

The pivotal interconnection between connected side wall elements could be releasable by providing the interconnected side wall elements with a row of apertures along an interconnection edge thereof and by providing a first coil member helically threaded through a plurality of apertures along the interconnection edge of a first side wall element, a second coil member helically threaded through a plurality of apertures along the interconnection edge of a second side wall element (connected to the first side wall element along the interconnection edge) and a releasable locking member threaded through overlapped first and second coil members.

Fill material used to fill the gabion may comprise at least one of sand, earth, soil, stones, rocks, rubble, concrete, debris, snow, and ice.

The gabion may optionally comprise a multi-compartmental gabion comprising opposed first and second side walls connected together at spaced intervals along the length of the gabion by a plurality of partition walls, the first and second side walls comprising a plurality of side wall element panels, at least one side wall element panel of the first side wall comprising an open framework panel lined with a first lining material having a relatively low water permeability compared with an unlined open framework panel, and further wherein at least one side wall element panel of the second side wall comprising an open framework panel which is lined with a second lining material having a higher water permeability than the first lining material.

The multi-compartmental gabion may optionally comprise opposed first and second side walls connected together at spaced intervals along the length of the gabion by a plurality of partition walls, the spaces between neighbouring pairs of partition walls defining, together with the first and second side walls, individual compartments of the multi-compartmental gabion, individual compartments of the multi-compartmental gabion being bounded by opposed side wall element panels of the respective opposed first and side walls, the partition walls being pivotally connected to the side walls, and the side wall element panels of the individual compartments of said first side wall being lined with a first lining material having a relatively low water permeability compared with an unlined open framework panel, and further wherein the side wall element panels of the individual compartments of said second side wall being lined with a second lining material having a higher water permeability than the first lining material.

Optionally, the connections between adjacent side and partition walls may be pivotal connections enabling the gabion to be folded between fully flattened and deployed configurations.

Optionally, adjacent walls of adjacent compartments are connected to one another by pivotal connections. Such an arrangement may allow the gabion to fold flat for storage or transport, e.g. in a zig-zag or concertina manner.

The gabion or multi-compartmental gabion as described above may be used for the protection of a manmade or natural structure against military assault or environmental dangers.

According to another aspect of the present invention, there is provided a water-containment system comprising a gabion, or a multi-compartmental gabion, according to one or more of the above described aspects and/or optional arrangements, wherein fill material is provided in the gabion, or at least one of the compartments of the multi-compartmental gabion.

According to another aspect of the present invention, there is provided a method of deploying a water containment system comprising: deploying a gabion, or a multi-compartmental gabion, according to one or more of the above described aspects and/or optional arrangements; providing fill material and locating at least a portion of the fill material in the gabion, or at least one of the compartments of the multi-compartmental gabion.

Where a deployed water containment system comprises a multi-compartmental gabion formed from wall elements, of which adjacent ones of said wall elements of an individual compartment, and of which adjacent wall elements of adjacent compartments, are connected to one another by releasable pivotal connections which when released allow a side wall element to open with respect to a compartment, the method may further comprise: opening one or more compartments in which fill material is depleted; re-filling the one or more compartments in which fill material is depleted with further fill material; closing the one or more compartments which have been re-filled.

One or more embodiments of the invention are described further hereinafter, by way of example only, with reference to the accompanying drawings in which.

Figure 1:
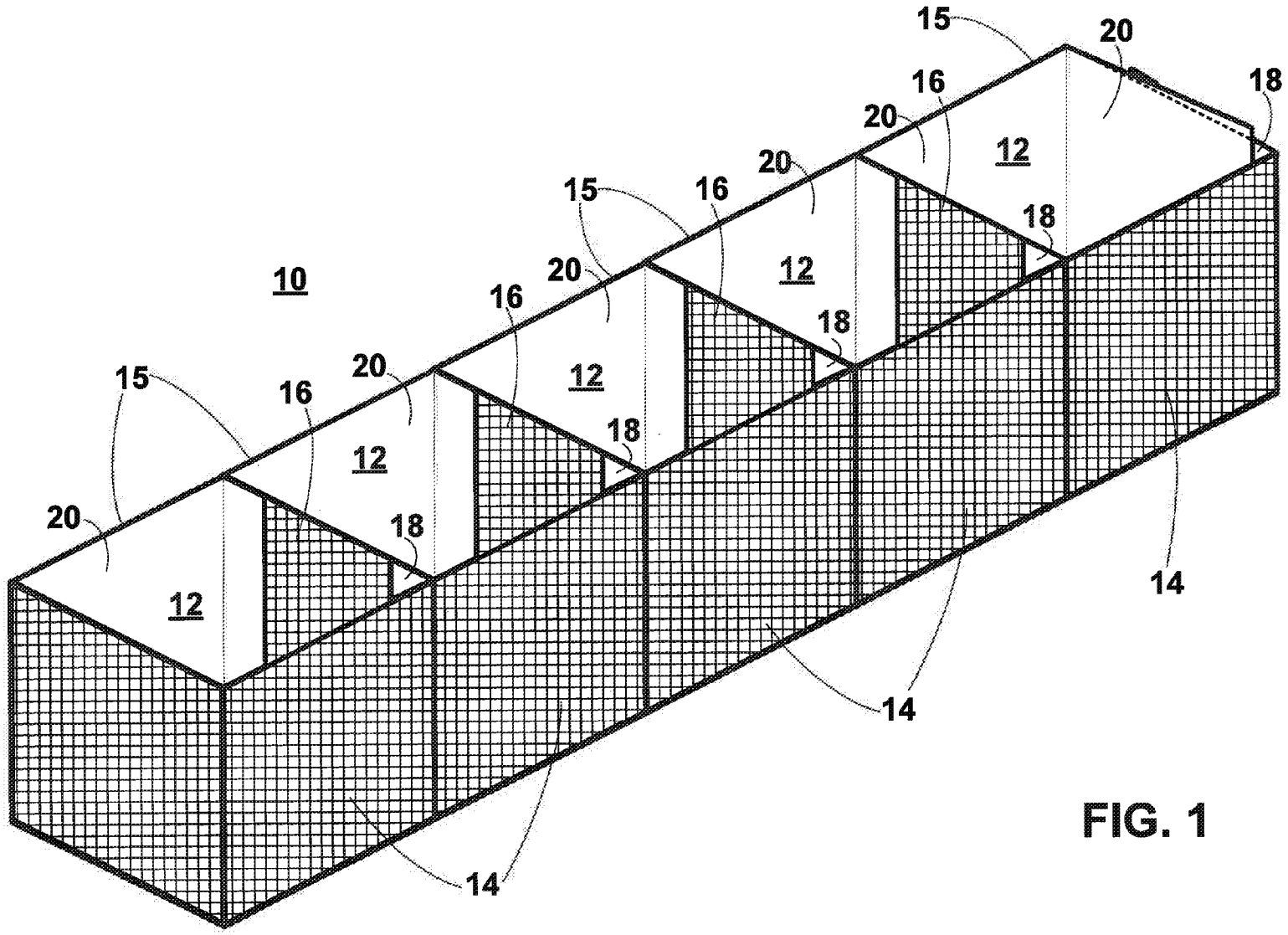
FIG. 1 shows a schematic perspective view of a gabion according to one or more embodiments of the present invention which may be suitable for use in a water containment system.
Figure 2:
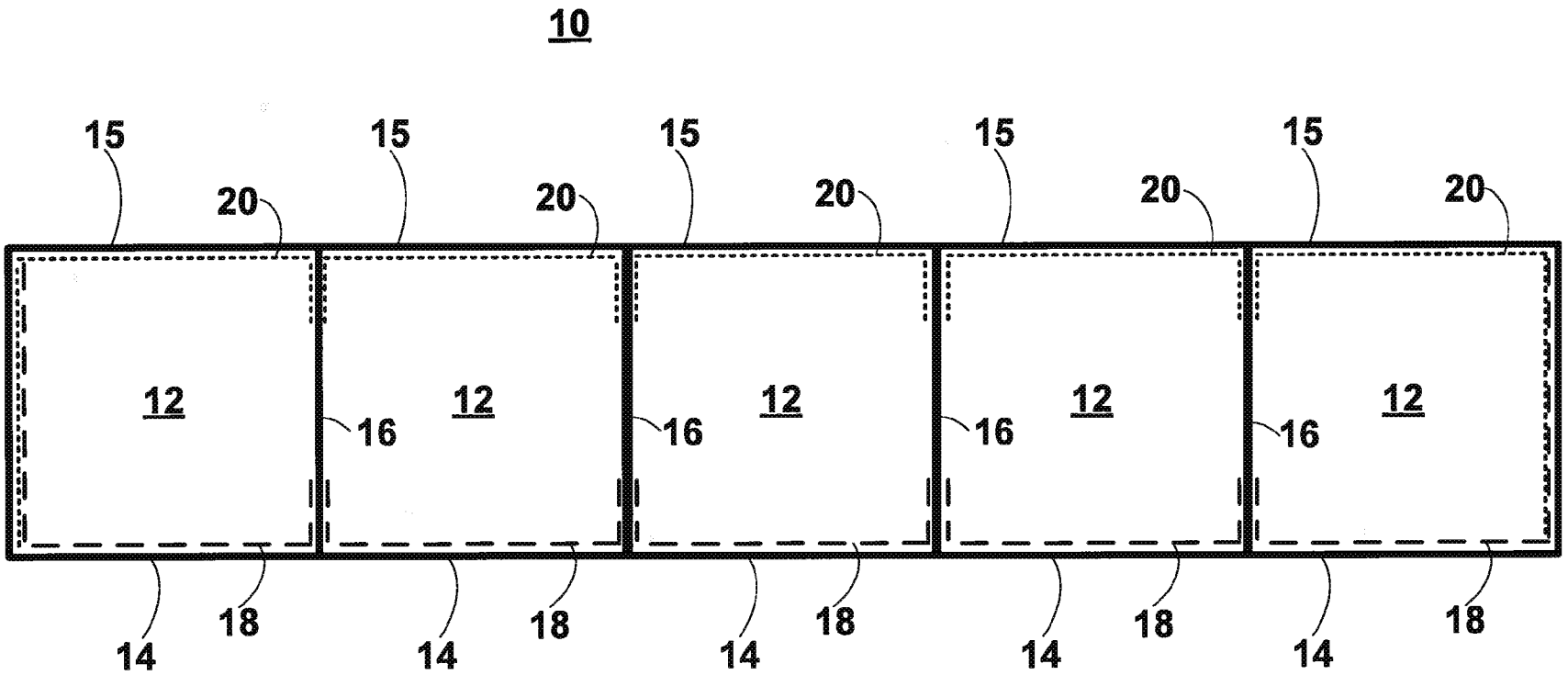
FIG. 2 shows a schematic top plan view of the gabion of FIG. 1.

FIGS. 1 and 2 illustrate perspective and top-plan views respectively of a multi-compartmental gabion 10 in an unfolded state. The gabion 10 comprises opposed side walls 14, 15 connected together at spaced intervals along the length of gabion 10 by a plurality of partition walls 16 defining, together with side walls 14,15, individual cells or compartments 12 of multi-compartmental gabion 10. Individual compartments 12 of multi-compartmental gabion 10 are bounded by opposed side wall sections of the respective opposed side walls 14, 15. Partition walls 16 are pivotally connected to side walls 14, 15 at hinge points at the corner of each compartment 12.

Figure 3:
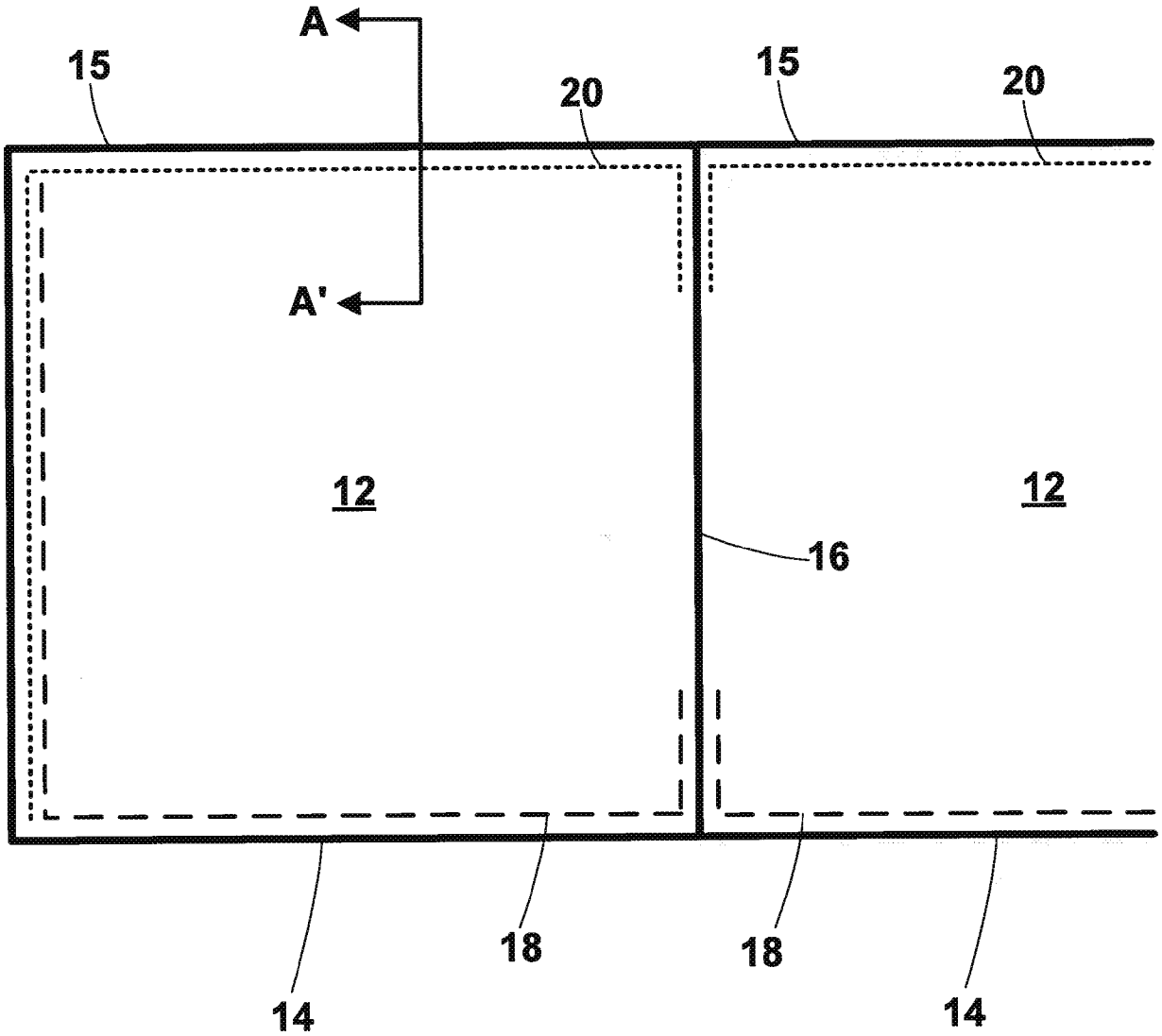
FIG. 3 shows a schematic enlarged plan view of two-compartments of the gabion of FIG. 2.

FIG. 3 comprises a schematic enlarged plan view of two-compartments of the gabion of FIGS. 1 and 2.

Each side wall section of multi-compartmental gabion 10 may be provided with openable pivotal connections, and with such pivotal connections being arranged for location between neighbouring side wall section. The pivotal connections between partition walls 16 (and other partition walls in the multi-compartmental gabion) and side walls 14, 15, and the openable pivotal connections between neighbouring side wall sections allow multi-compartmental gabion 10 to fold concertina-wise for flat-packing in transportation and storage.

In the arrangements illustrated in FIGS. 1 to 3, the side walls 14, 15 comprise a plurality of open framework panels arranged to form the side wall sections. The first side wall 14 comprises a plurality of open framework panels lined with a lining material comprising a first lining material 18. The second side wall 15 comprises a plurality of open framework panels lined with a lining material comprising a second lining material 20. The permeability of the first lining material 18 is lower than that of the second lining material 20, and the permeability of the second lining material 20 is lower than the permeability of an unlined open framework panel.

In a particular arrangement, the gabion 10 may be positioned so that the first side wall, and thus the first lining material 18, is located to face a body of water from which flooding is expected, i.e. the first lining material 18 is on the "water-side" of the gabion 10. The second lining material 20 will face away from the body of water, i.e. it is on a "dry-side" of the gabion 10.

Optionally, the first lining material 18 is impermeable, or substantially impermeable, or of a relatively low permeability compared with the second lining material 20, and may comprise Dura-Dry®. Further optionally, second lining material 20 may comprise Geo-Tex® 643, manufactured by Propex™, and/or Geo-Tex® 645, by Propex™.

Both the first and second lining materials 18, 20 may serve to retain fill material within the compartments 12 of the gabion 10. Further, should flood-waters advance sufficiently to wash against the gabion 10, then the low-permeability lining material forming the first lining material 18 may inhibit the passage of water into the fill material through the open framework, or mesh, of the gabion 10 on the water-side. This may serve to inhibit saturation of the fill material, which may be undesirable as this may weaken the structure of a flood-defence system which incorporates the gabion 10.

However, it may be the case that high winds or high tides, or a combination of both, may cause flood-waters to overtop the water-side of the gabion 10 (e.g. during a storm-surge). This may negate the effect of the first lining material 18 and fill material may become saturated in any event. Additionally, adverse weather conditions which are likely to accompany flood-conditions may mean that water from rainfall also soaks into the fill material and may be a factor in causing the fill material to become saturated. As noted above, this may undesirable in certain instances. If the fill material becomes saturated, then this may result in overloading of the gabion side walls 14, 15, partition walls 16, and/or connections between adjacent walls and, potentially, may lead to failure of at least a section of the gabion structure. However, because the second side wall 15 (located to face the dry-side of the flood-defence system in this arrangement) is lined with the second lining material 20, which has a higher permeability than the first lining material 18, any water which soaks into the fill material may be able to drain away gradually through the permeable second lining material 20.

In another optional arrangement, the second side wall 15 may be unlined (i.e. the second lining material 20 is not present), and any water which soaks into the fill material may be able to drain away through the open framework, or mesh, of the unlined second side wall 15.

As illustrated in FIGS. 1 to 3, the first lining material 18 extends over an entire inner side of the first side wall 14 forming a side wall of each individual compartment 12. Further, in each compartment 12 of the gabion 10, the first lining material 18 also extends over a portion of both the partition walls 16 which bound the compartment 12 and which extend from the first side wall 14.

Second lining material 20 is arranged in each compartment in a similar manner with respect to the second side wall 15 and partition walls 16.

Thus, in the illustrated arrangement of FIGS. 1 to 3, a portion of the partition wall 16 between each of the adjacent compartments is unlined. By leaving a part of each partition wall 16 unlined, this may serve to allow fill material in adjacent compartments 12 to pass through the open framework of the unlined portion of the partition walls 16. This may be useful in allowing the fill material in one compartment to bind, or interlock, with the fill material in an adjacent compartment. Such binding or interlocking may serve to improve the strength of the gabion structure and may potentially reduce shearing between adjacent compartments. Shearing between adjacent compartments may arise due to water washing against the water-side of the gabion 10 (e.g. wave impacts).

Optionally, in end compartments of the gabion 10, the first and second lining materials 18, 20 may overlap, at least partially, or entirely (as illustrated in FIGS. 2 and 3) to cover an internal surface of an end partition wall 16. Further optionally, a portion of the surface of the end partition walls 16 may be unlined (i.e. in the same manner as the partition walls 16 between adjacent compartments 12).

Figure 4:
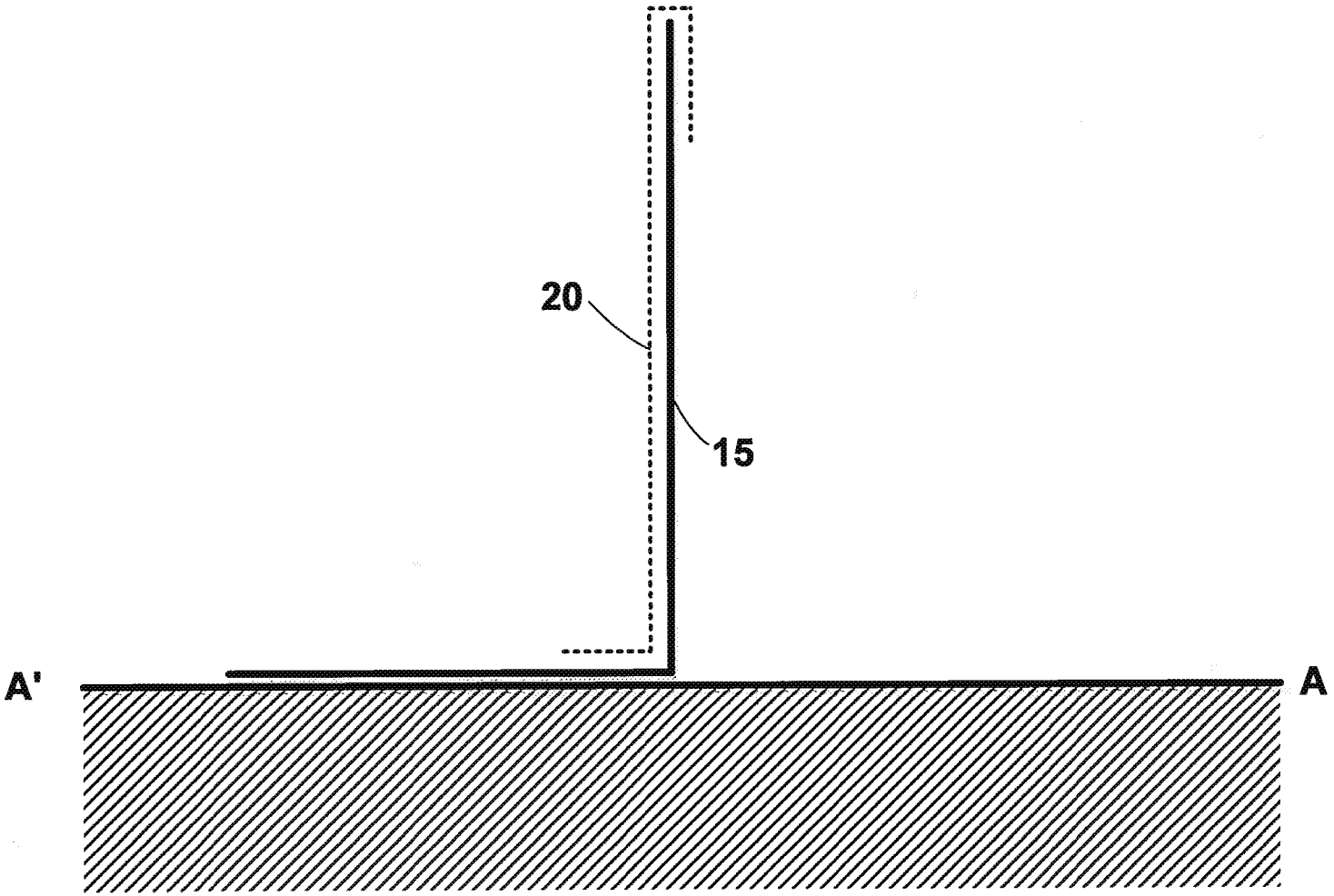
FIG. 4 shows a schematic cross-sectional side view along line A-A' of the gabion of FIG. 3.

FIG. 4 shows a schematic cross-sectional side view taken along line A-A' of the gabion of FIG. 3.

As can be seen from the figure, second lining material 20 extends over second side wall 15 on an inner surface thereof. The second lining material 20 also extends over a top edge of the second side wall 15 and downwardly therefrom over a portion of the outer surface of the second side wall 15. Further, the second lining material 20 may be arranged to extend inwardly (i.e. from an inner surface of the side wall toward a central region of a compartment) adjacent to a bottom edge of the second side wall 15.

First lining material 18 may be arranged in each compartment in a similar manner with respect to the first side wall 14.

Once the multi-compartmental gabion has been deployed as required, one or more compartments of the gabion can be filled with fill material to form a water containment or flood-defence system.

Figure 5:
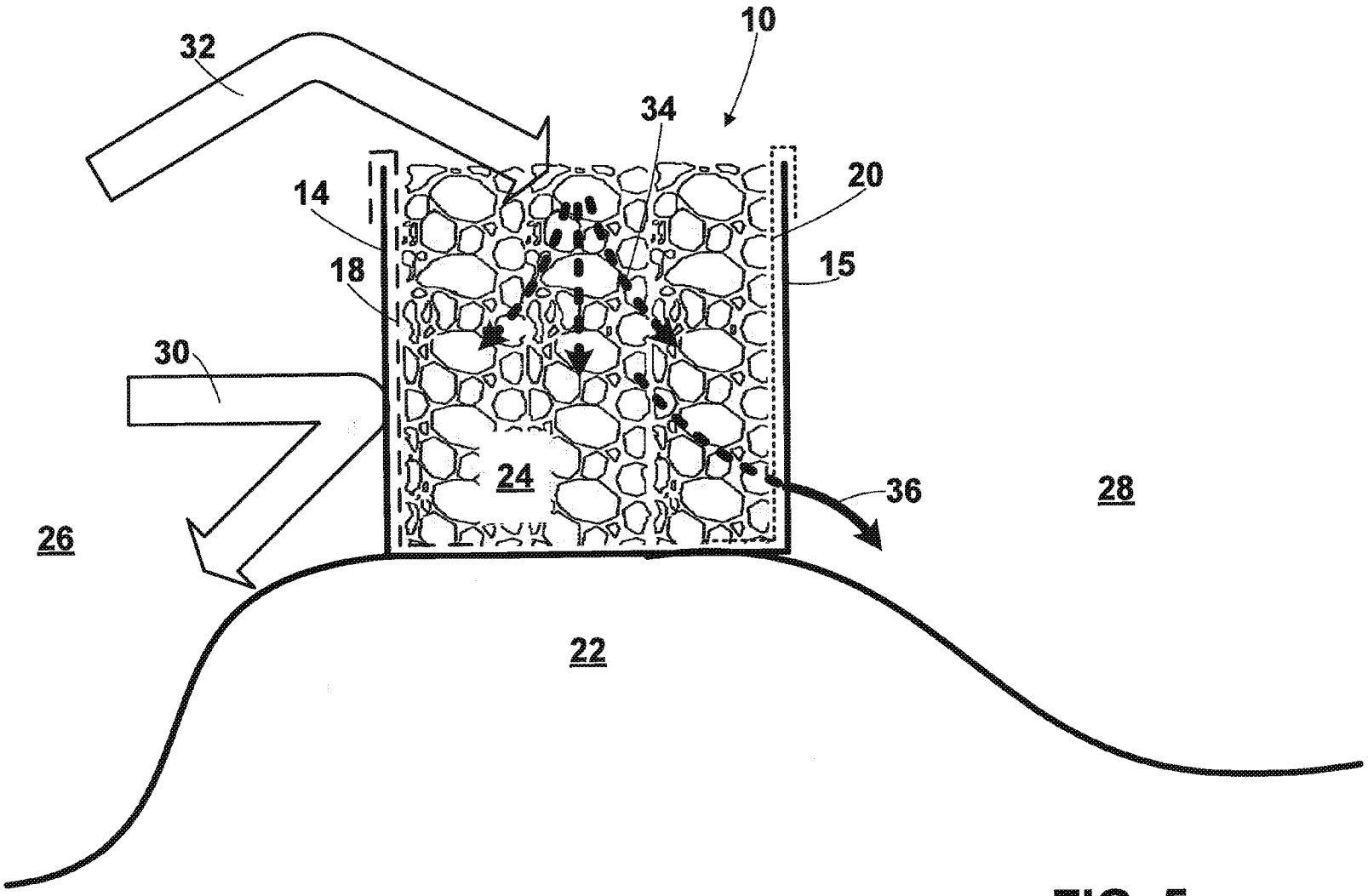
FIG. 5 shows a schematic side view of a fully deployed water containment system according to one or more embodiments of the present invention.

FIG. 5 shows a schematic side view of a fully deployed water containment system or flood-defence system according to one or more embodiments of the present invention.

The gabion 10 is located on ground 22 adjacent a body of water. In a particular example, the gabion 10 may have been rapidly deployed from a folded configuration to an unfolded, or deployed configuration (such as illustrated in FIG. 1) and subsequently filled with fill material. Optionally, deployment may have been achieved by deploying the gabion by hand from a storage container/package. Further optionally, deployment may have been achieved using specialist equipment and/or vehicles to deploy the gabion from a storage container/package. The location where the gabion 10 is deployed may be, for example, on a river-bank, on a shore-line, on a levee, or at any place where there is likely to be a flood-risk.

Compartments of the gabion 10 are filled with fill material 24 which may comprise, for example, soil, debris, rubble, sand, any other type of material which may be suitable, or any combination of these materials.

The gabion 10 may serve to reduce the risk of water from a body of water adjacent the gabion 10 on a water-side 26 thereof reaching an area of land adjacent the gabion 10 on a dry-side 28 thereof.

As illustrated, the gabion 10 is located so that first side wall 14 and its lining of first lining material 18 face the water-side 26. Thus, should water from the body of water advance sufficiently to wash against the gabion 10, then the first lining material 18 may inhibit the passage of water into the fill material through the open framework, or mesh, of the gabion 10. Thus, advancing water may be repelled by the first lining material 18 as illustrated by arrow 30 in the figure.

It may be the case that high winds or high tides, or a combination of both, may cause flood-waters to over-top the water-facing side of the gabion 10 (e.g. during a storm-surge). This process is illustrated by arrow 32 in the figure. The water may soak into the fill material 24 (as illustrated by arrows 34). Additionally, adverse weather conditions which are likely to accompany flood-conditions may mean that water from rainfall also soaks into the fill material 24, thereby furthering the likelihood of the fill material 24 becoming saturated. As described previously, this may be undesirable in certain instances. If the fill material 24 becomes saturated, then a concern is that this may result in overloading of the gabion walls and/or connections between adjacent walls and, potentially, may lead to failure of at least a section of the gabion structure. However, because the second side wall 15 (located to face the land-side, or dry-side 28, of the flood-defence system in this arrangement) is lined with second lining material 20, which is more permeable than the first lining material 18, then any water which soaks into the fill material 24 may be able to drain away through second lining material 20 (as indicated by arrow 36).

Optionally, the first and/or second lining materials 18, 20 may be held in place relative to the side walls 14, 15 and/or partition walls 16 by any suitable fixing elements.

Although specific reference is made to multi-compartmental gabions in the above described arrangements, the arrangements also may be implemented in a gabion comprising a single compartment or cell.

Any references made herein to orientation (e.g. top, bottom, front and back) are made for the purposes of describing relative spatial arrangements of the features of the apparatus, and are not intended to be limiting in any sense.

The invention claimed is:

1. A gabion comprising opposed first and second side walls connected by partition walls, the first and second side walls comprising open framework panels, wherein the space between adjacent partition walls define, together with the first and second side walls, an individual compartment of the gabion, wherein the first side wall is lined with a first lining material extending over an entire side of the first side wall, the first lining material having a relatively low water permeability compared with an unlined open framework panel, and wherein the second side wall is lined with a second lining material extending over an entire inner side of the second side wall, the second lining material having a higher water permeability than the first lining material.

2. The gabion according to claim 1, wherein the first lining material is impermeable.

3. The gabion according to claim 1, wherein the first lining material extends over a connection between the first side wall and at least one partition wall extending therefrom.

4. The gabion according to claim 1, wherein the first lining material extends at least partly across a surface of at least one partition wall extending from the first side wall.

5. The gabion according to claim 4, wherein a portion of a surface of said at least one partition wall is unlined.

6. The gabion according to claim 1, wherein the second lining material extends over a connection between the second side wall and at least one partition wall extending therefrom.

7. The gabion according to claim 6, wherein the second lining material extends at least partly across a surface of at least one partition wall extending from the second side wall.

8. The gabion according to claim 7, wherein a portion of a surface of said at least one partition wall is unlined.

9. The gabion according to claim 1, wherein said first and/or second lining material comprises a sheet material.

10. The gabion according to claim 9, wherein said sheet material comprises a multi-layer material.

11. The gabion according to claim 1, wherein the first lining material comprises a non-woven geotextile.

12. The gabion according to claim 1, wherein the second lining material comprises a non-woven geotextile.

13. The gabion according to claim 1, wherein said first side wall and/or second side wall and/or partition walls of the gabion are formed from rigid mesh panels.

14. The gabion according to claim 1, wherein said partition walls and first and second side walls are connected to one another by pivotal connections.

15. The gabion according to claim 14, wherein the first and second side walls comprise a plurality of side wall element panels, wherein at least one of the pivotal connections is a releasable connection which when released allows a side wall element to open with respect to a compartment.

16. The gabion according to claim 15, wherein the releasable connection comprises a hinge member associated with an edge of each adjacent wall to be connected.

17. The gabion according to claim 16, wherein the or each hinge member comprises a helical spring.

18. The gabion according to claim 16, wherein the or each releasable connection comprises a releasable locking member releasably securing the hinge members of each pivotal connection to one another.

19. The gabion according to claim 14, wherein the pivotal connections between connected walls are achieved by providing interconnected walls with a row of apertures along an interconnection edge thereof and by providing a coil member helically threaded through a plurality of apertures along the interconnection edge.

20. The gabion according to claim 1, wherein the gabion is filled with fill material.

21. The gabion according to claim 20, wherein the fill material comprises at least one of sand, earth, soil, stones, rocks, rubble, concrete, debris, snow, and ice.

22. The gabion according to claim 1, wherein the gabion is a multi-compartmental gabion, wherein the opposed first and second side walls are connected together at spaced intervals along the length of the gabion by a plurality of partition walls, wherein spaces between neighbouring pairs of partition walls define, together with the first and second side walls, individual compartments of the multi-compartmental gabion being bounded by opposed side wall element panels of the respective opposed first and side walls, defining a plurality of compartments, the first and second side walls comprising a plurality of side wall element panels, wherein at least one side wall element panel of the first side wall comprises an open framework panel lined with a first lining material extending over an entire inner side of the first side wall, the first lining material having a relatively low water permeability compared with an unlined open framework panel, and wherein at least one side wall element panel of the second side wall comprises an open framework panel lined with a second lining material extending over an entire inner side of the second side wall, the second lining material having a higher water permeability than the first lining material.

23. The multi-compartmental gabion according to claim 22, wherein the partition walls are pivotally connected to the side walls.

24. The multi-compartmental gabion according to claim 23, wherein the connections between adjacent side and partition walls are pivotal connections enabling the gabion to be folded between fully flattened and deployed configurations.

25. The multi-compartmental gabion according to claim 23, wherein adjacent walls of adjacent compartments are connected to one another by pivotal connections.

26. A water-containment system, comprising the multi-compartmental gabion according to claim 22, wherein fill material is provided in at least one of the compartments of the multi-compartmental gabion.

27. A method of rapidly deploying a water containment system comprising:

deploying the multi-compartmental gabion according claim 22;

providing fill material; and locating at least a portion of the fill material in at least one of the compartments of the multi-compartmental gabion.

28. A water-containment system comprising the gabion according to claim 1, wherein fill material is provided in the gabion.

29. A method of rapidly deploying a water containment system comprising:

deploying the gabion according to claim 1;

providing fill material; and locating at least a portion of the fill material in the gabion.

30. The gabion according to claim 1, wherein the first and/or second lining materials are held in place relative to the side walls and/or partition walls.

31. A gabion comprising opposed first and second side walls connected by partition walls, the first and second side walls comprising open framework panels, wherein the space between adjacent partition walls define, together with the first and second side walls, an individual compartment of the gabion, wherein the first side wall is lined with a first lining material extending over an entire inner side of the first side wall, the first lining material having a relatively low water permeability compared with an unlined open framework panel, and wherein the second side wall is lined with a second lining material extending over an entire inner side of the second side wall, the second lining material having a higher water permeability than the first lining material.

* * * * *